US007832726B2

(12) United States Patent
Osakabe

(10) Patent No.: US 7,832,726 B2
(45) Date of Patent: Nov. 16, 2010

(54) SHEET-CONVEY DEVICE AND IMAGE READING DEVICE

(75) Inventor: Yoshinori Osakabe, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/342,009

(22) Filed: Dec. 22, 2008

(65) Prior Publication Data

US 2009/0166953 A1 Jul. 2, 2009

(30) Foreign Application Priority Data

Dec. 28, 2007 (JP) ..... 2007-339267

(51) Int. Cl.
*B65H 1/00* (2006.01)
*B65H 7/02* (2006.01)
*B65H 7/08* (2006.01)

(52) U.S. Cl. ..... 271/261; 271/265.03; 271/171

(58) Field of Classification Search ..... 271/261, 271/265.03, 171; 399/370, 376; 358/488, 358/498

See application file for complete search history.

(56) References Cited

U.S. PATENT DOCUMENTS 3,689,143 A * 9/1972 Case et al. ..... 399/86
4,920,384 A * 4/1990 Okamoto ..... 399/86
2006/0083565 A1 4/2006 Morimoto

FOREIGN PATENT DOCUMENTS

JP 61174035 A * 8/1986
JP S62-093158 A 4/1987
JP 2006-115428 A 4/2006

* cited by examiner

*Primary Examiner*—David H Bollinger
(74) *Attorney, Agent, or Firm*—Baker Botts L.L.P.

(57) ABSTRACT

A sheet-convey device, includes a holder, a convey member, and a recognizer. On the holder, a first sheet having a first width and a second sheet having a second width larger than the first width are placeable. The convey member conveys a sheet placed on the holder in a predetermined direction. The recognizer recognizes a width of the sheet and includes first and second sensors for sensing whether a part of the sheet is present at respective first and second positions of the holder. The first position is located inside of the first width in the widthwise direction with the first sheet placed on the holder, while the second position is located outside of the first width and inside of the second width with the second sheet placed on the holder. The second position is located upstream of the first position in the predetermined direction.

19 Claims, 7 Drawing Sheets

SHEET-CONVEY DEVICE AND IMAGE READING DEVICE

CROSS REFERENCE TO RELATED APPLICATION

The present application claims priority from Japanese Patent Application No. 2007-339267, which was filed on Dec. 28, 2007, the disclosure of which is herein incorporated by reference in its entirety.

BACKGROUND OF THE INVENTION

1. Field of the Invention

The present invention relates to a sheet-convey device configured to recognize a width of a sheet to be conveyed, and relates to an image reading device which is equipped with the sheet-convey device.

2. Description of the Related Art

A conventional image reading device is provided with a sheet-convey device. The sheet-convey device conveys a document sheet placed on a sheet holder along a sheet-convey path and discharges the document sheet onto a sheet-discharge tray. In the image reading device, an image of the document sheet passing through the sheet-convey path is read, at a specific position of the sheet-convey path, by a line sensor in a process in which the document sheet is conveyed.

Patent Document 1 (Japanese Patent Application Publication No. 2006-115428) discloses an image reading device provided with a sheet sensor and a sheet-width sensor on a sheet-convey path. The sheet sensor is for sensing the document sheet being conveyed through the sheet-convey path. The sheet sensor is provided at a position at which document sheets of all sizes which are conveyed along the sheet-convey path can be sensed. The sheet-width sensor is for sensing an edge portion of the document sheet in a direction perpendicular to a direction in which the document sheet is conveyed. On the basis of a result of the sensing of the sheet-width sensor, there is judged whether the document sheet to be conveyed along the sheet-convey path is a document sheet of a relatively large size (e.g., A3 size and B4 size) or a document sheet of a relatively small size (e.g., A4 size and B5 size). Since the sheet-width sensor is provided on the sheet-convey path, even where a plurality of the document sheets of different sizes are stacked on the sheet tray, a width of the document sheet can be recognized when the document sheet is supplied or introduced into the sheet-convey path.

Patent Document 2 (Japanese Patent Application Publication No. 62-93168) discloses an image reading device in which six sensors for sensing a document sheet are provided on a sheet tray. These sensors are arranged in a row in a direction perpendicular to a direction in which the document sheet is conveyed. In this image reading device, on the basis of a result of the sensings of the respective sensors, a width of the document sheet placed on the sheet tray is recognized.

Further, on a sheet tray of the conventional image reading device, there are provided a pair of side guides. The side guides are respectively brought into contact with side edges of the document sheet placed on the sheet tray. The side guides are slidable in a widthwise direction of the sheet tray (the above-described direction perpendicular to the direction in which the document sheet is conveyed). These side guides are constructed such that when one of the side guides is slid in a certain direction in the widthwise direction, the other of the side guides is cooperated to be slid in a direction opposite to the certain direction. When the side guides are slid in a state in which the document sheet is placed on the sheet tray, the side guides are respectively brought into contact with both of the side edges of the document sheet, whereby the document sheet is positioned. As a result, regardless of a width of the document sheet placed on the sheet tray, a center of the document sheet in the widthwise direction is positioned at a prescribed position (e.g., a center of the sheet tray in the widthwise direction).

SUMMARY OF THE INVENTION

Meanwhile, document sheets of different sizes are placed on the sheet tray. Thus, the pair of side guides are disposed at respective positions corresponding to the width of the document sheet to be placed on the sheet tray. In a state in which the side guides are disposed such that a distance therebetween is equal to the width of the document sheet, a user cannot smoothly place the document sheet on the sheet tray. Thus, the document sheet is placed on the sheet tray in a state in which the side guides are disposed such that the distance therebetween is slightly larger than the width of the document sheet. In this case, the document sheet is not sufficiently regulated by the side guides. Further, since the document sheet is manually placed by the user, the document sheet may be oblique relative to the sheet tray. Where the document sheet is obliquely placed as thus described, a corner portion of a leading end of the document sheet is deviated upstream in the sheet-convey direction. In the image reading device disclosed in the Patent Document 2, as described above, the plurality of sensors are arranged in a row in the direction perpendicular to the direction in which the document sheet is conveyed. Thus, though the corner portion of the leading end of the document sheet is sensed by the sensor where the document sheet is properly placed at a predetermined setting position of the sheet tray, the corner portion is not sensed where the corner portion is deviated on the upstream side of the plurality of sensors in the sheet-convey direction. As a result, the width of the document sheet is misrecognized, so that the document sheet is not normally read, unfortunately.

Further, the sheet-convey device may be used as a sheet-convey means for conveying a recording sheet placed on, e.g., a manual sheet-supply tray in a printer. In a construction of the sheet-convey device in which the plurality of sensors for sensing the recording sheet are arranged on the manual sheet-supply tray in a row in a direction perpendicular to a direction in which the recording sheet is supplied, where the corner portion of the leading end of the recording sheet is deviated on an upstream side of the sensors in the direction in which the recording sheet is supplied, a width of the recording sheet is misrecognized like the above-described misrecognition of the width of the document sheet. As a result, a recording sheet whose size is different from that of a recording sheet to be planned to be supplied is supplied from the manual sheet-supply tray to the printer. As a result, there arises a problem in which an image is recorded on a recording sheet of a size which is not desired by the user.

This invention has been developed in view of the above-described situations, and it is an object of the present invention to provide a sheet-convey device which can reduce occurrence of in is recognition of a width of a sheet caused because the sheet is obliquely placed, and to provide an image reading device on which the sheet-convey device is mounted.

The object indicated above may be achieved according to the present invention which provides a sheet-convey device, comprising: a sheet holder on which a first sheet having a first width is placeable at a predetermined setting position and on which a second sheet having a second width larger than the first width is placeable at the predetermined setting position;

a sheet-convey member configured to convey a sheet placed on the sheet holder in a predetermined sheet-convey direction perpendicular to a widthwise direction of the sheet; a sheet-width recognizer configured to recognize a width of the sheet; wherein the sheet-width recognizer includes (a) a first sensor for sensing whether a part of the sheet is present or absent at a first position of the sheet holder and (b) a second sensor for sensing whether a part of the sheet is present or absent at a second position of the sheet holder; wherein the first position is set so as to be located on an inside of the first width in the widthwise direction in a state in which the first sheet is placed on the sheet holder, while the second position is set so as to be located on an outside of the first width in the widthwise direction in the state in which the first sheet is placed on the sheet holder and on an inside of the second width in the widthwise direction in the state in which the second sheet is placed on the sheet holder; and wherein the second position is set so as to be located on an upstream side of the first position in the sheet-convey direction.

The object indicated above may also be achieved according to the present invention which provides an image reading device, comprising: the sheet-convey device; a sheet-convey path through which the sheet placed on the sheet holder is conveyed by the sheet-convey device; and a line sensor configured to read, at a specific position of the sheet-convey path, an image formed on the sheet being passed through the sheet-convey path.

In the sheet-convey device and the image reading device constructed as described above, even where the second sheet having the second width is obliquely placed on the sheet holder 30, and a corner portion of a leading end of the second sheet is deviated upstream relative to the predetermined setting position in the sheet-convey direction, the corner portion is sensed by the second sensor. Thus, there can be reduced occurrence of misrecognition of the width of the document sheet caused because the document sheet is obliquely placed.

It is noted that the sheet-convey member is a roller which is driven to be rotated in a state in which the sheet-convey member is held in contact with the sheet placed on the sheet holder, for example. Further, the first, second, and third sensors may be provided by optical sensors and may be provided by mechanical sensors.

BRIEF DESCRIPTION OF THE DRAWINGS

The objects, features, advantages, and technical and industrial significance of the present invention will be better understood by reading the following detailed description of a preferred embodiment of the invention, when considered in connection with the accompanying drawings, in which.

DESCRIPTION OF THE PREFERRED EMBODIMENT

Hereinafter, there will be described a preferred embodiment of the present invention by reference to the drawings. It is to be understood that the following embodiment is described only by way of example, and the invention may be otherwise embodied with various modifications without departing from the scope and spirit of the invention.

General Construction of Scanner 10

Initially, there are explained a construction and operations of a scanner 10 as an embodiment of an image reading device to which the present invention is applied. The scanner 10 has a scanning function for reading an image formed on a document sheet. This embodiment will be explained taking the scanner 10 having only the scanning function as an example. However, the image reading device to which the present invention is applied is not limited to this scanner 10. The image reading device may be realized as a part of a Multi Function Device (MFD) having, e.g., a copying function and a printing function as long as the image reading device has the scanning function. Actually, this scanner 10 is a part of the MFD including a printer and an operational panel which is provided below the scanner 10. However, the printer and the operational panel are not directly related to the present invention, and thus omitted in FIG. 1.

Figure 1:
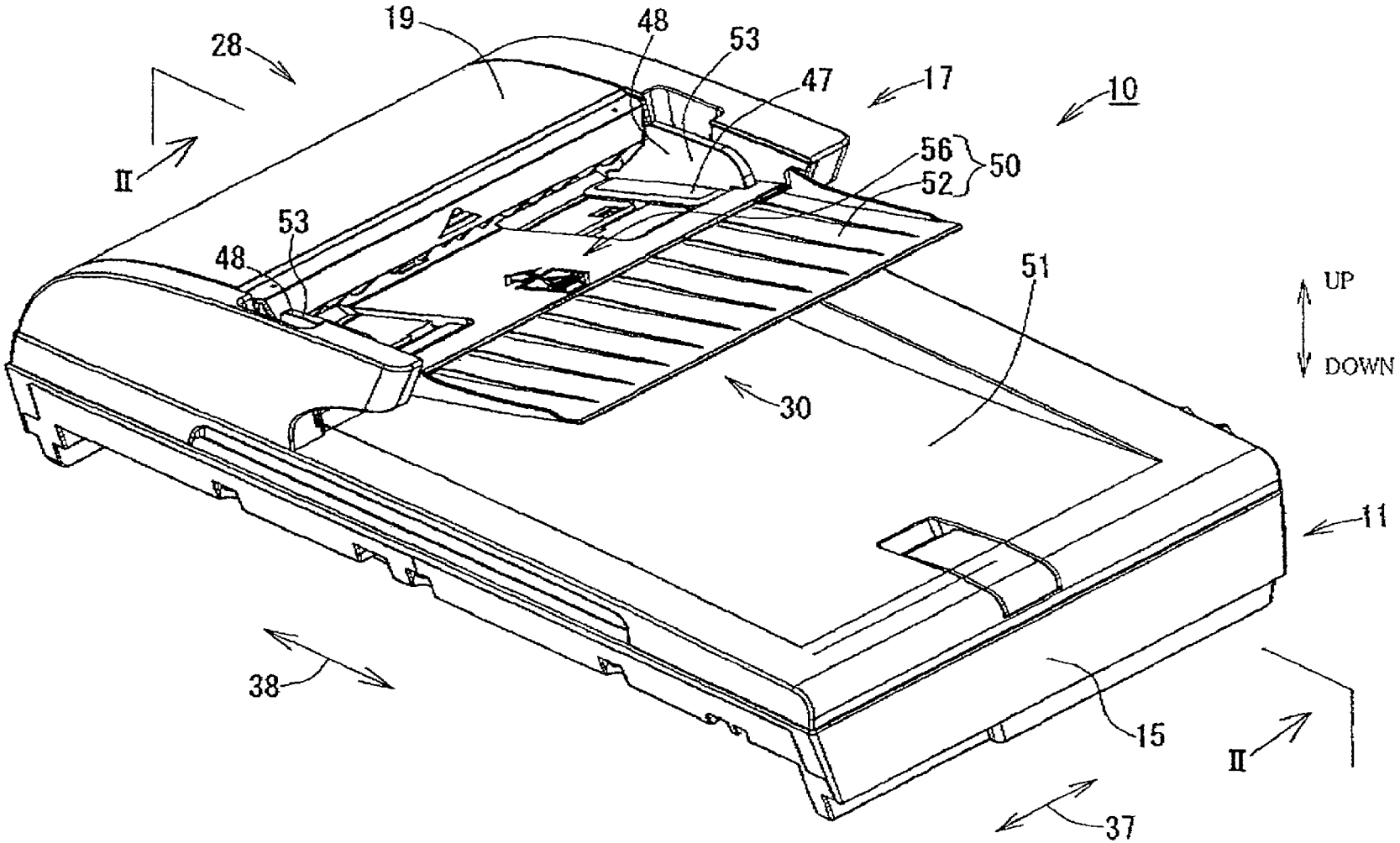
FIG. 1 is a perspective view showing an external construction of a scanner 10 as an embodiment of the present invention.

As shown in FIG. 1, the scanner 10 includes a sheet table 11 and a sheet cover 17 when broadly divided. The sheet table 11 functions as a Flat Bed Scanner (FBS). The sheet table 11 includes a casing 15 having a generally rectangular parallelepiped shape. In the casing 15, there is provided a line sensor 40 described below (with reference to FIGS. 2 and 5).

The sheet cover 17 closely contacts the document sheet placed on a contact glass 20 (with reference to FIG. 2) with the contact glass 20. The sheet cover 17 is provided so as to be opened and closed with respect to the sheet table 11. Specifically, the sheet cover 17 is pivotably connected to the sheet table 11 via a hinge 13 (with reference to FIG. 3) which is provided at a portion of the sheet table 11 which is nearer to a back face thereof. It is noted that FIG. 3 shows the scanner 10 in a state in which a covering member 19 is removed. This sheet cover 17 includes an Auto Document Feeder (ADF) 28 as a sheet-convey device to which the present invention is applied. The ADF 28 conveys, along a sheet-convey path 12 (with reference to FIG. 2), the document sheet placed on a sheet holder 30 functioning as a sheet-placed portion. In the scanner 10, the image formed on the document sheet placed on the contact glass 20 (with reference to FIG. 2) or the image formed on the document sheet conveyed by the ADF 28 along the sheet-convey path 12 is read by the line sensor 40.

Figure 2:
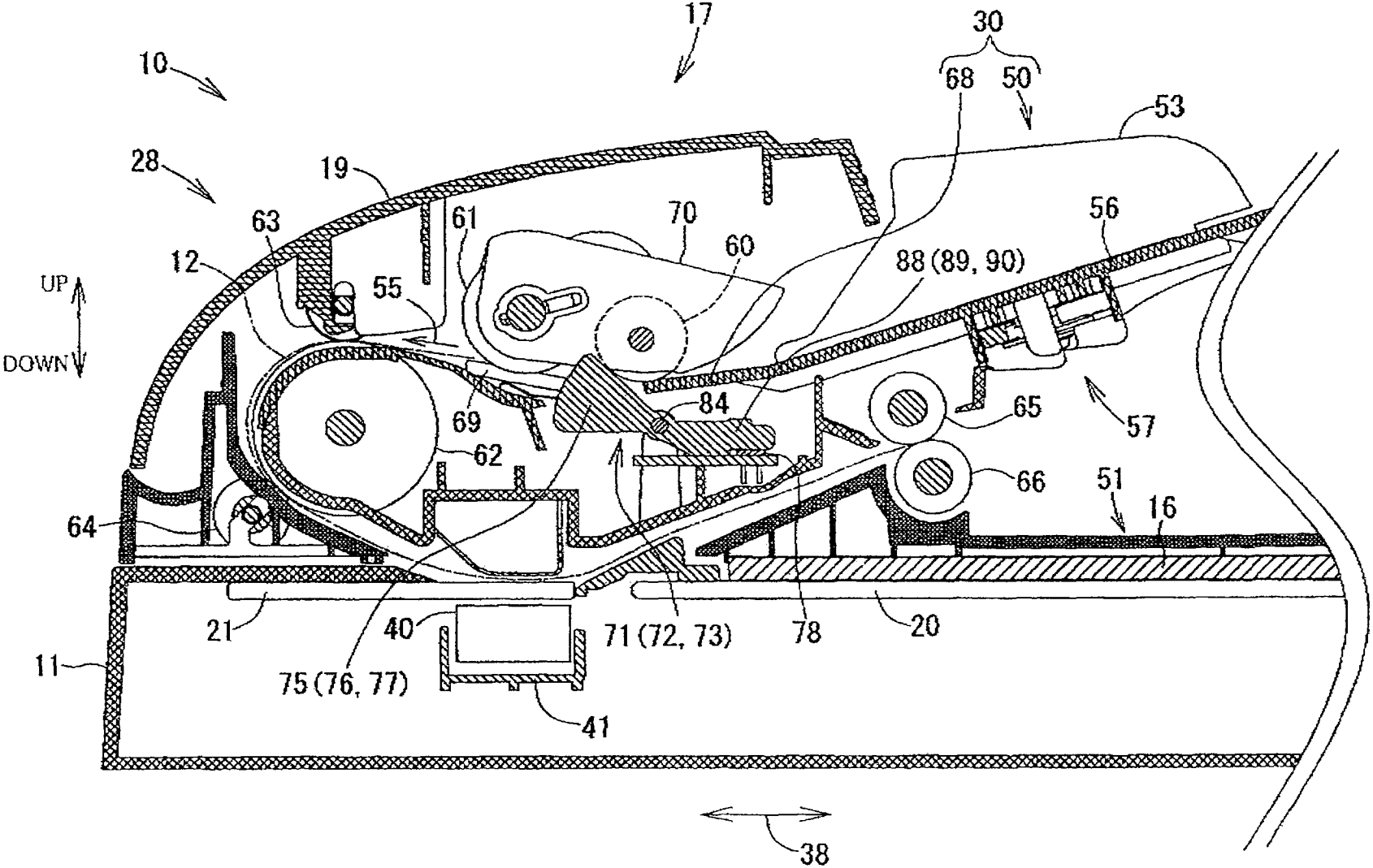
FIG. 2 is a cross sectional view of the scanner 10 taken along a line II-II in FIG. 1.
Figure 3:
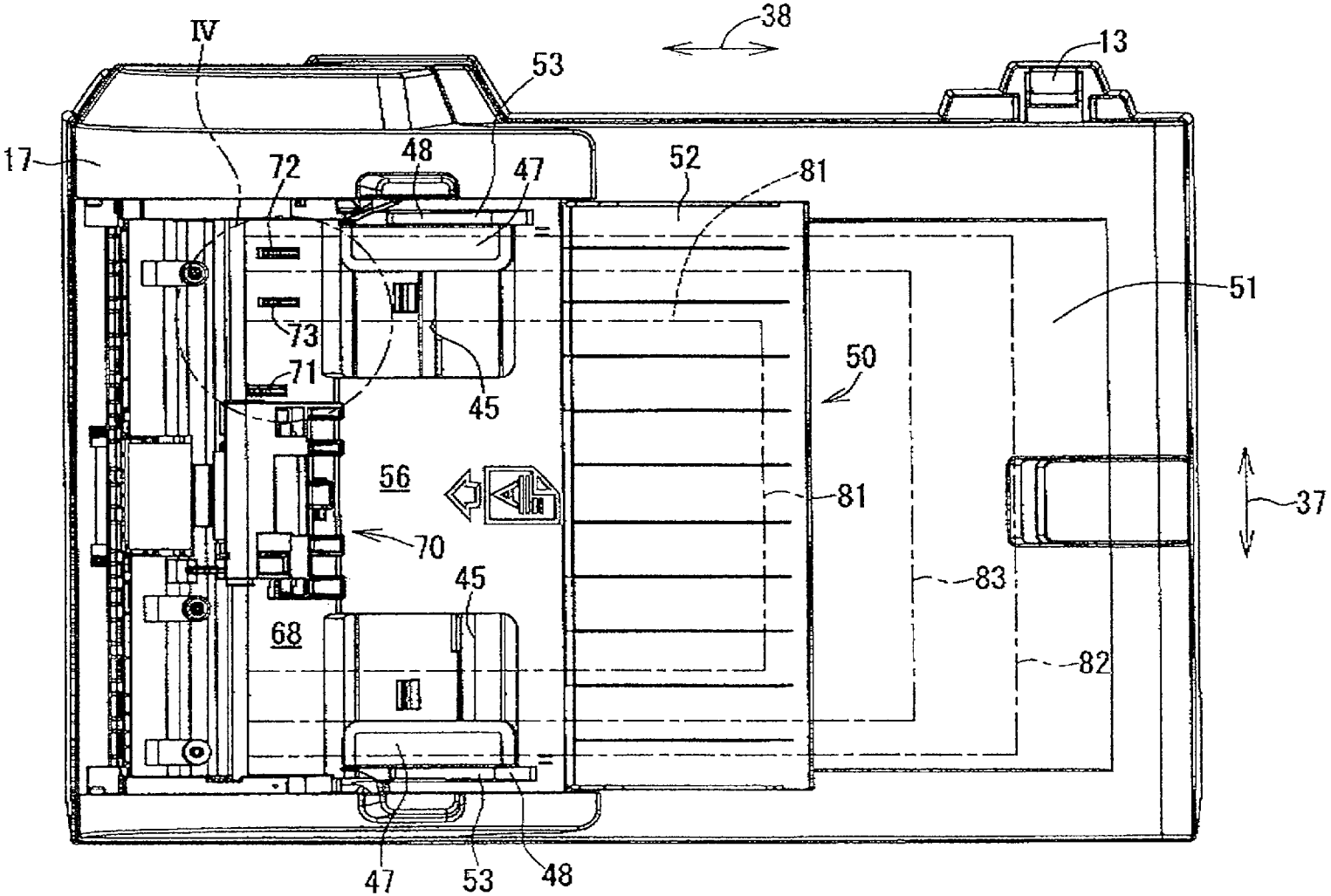
FIG. 3 is a plan view of the scanner 10 in a state in which a covering member 19 is removed.

The line sensor 40 (with reference to FIGS. 2 and 5) emits a light from a light source to the document sheet and reads a light reflected from the document sheet for every line in a main scanning direction of the sheet which is perpendicular to a surface of a paper sheet on which FIG. 2 is shown. As the line sensor 40, there is used a reading device with a relatively short focal length. In this scanner 10, the line sensor 40 is what is called a Contact Image Sensor (CIS). Though not shown in any of the figures, the line sensor 40 includes the light source, a lens, and light-receiving elements. The line sensor 40 emits the light to the document sheet from the light source through the contact glass 20 or a contact glass 21. The line sensor 40 converts the light reflected from the document sheet, to an electric signal (image signal) by gathering the reflected light into the light-receiving elements through the lens. As a result, the image formed on the document sheet can be obtained. Parts of the light-receiving elements of the line sensor 40 are provided by, e.g., chips, and the chips are arranged in the main scanning direction. The light source and the lens of the line sensor 40 are also arranged in the main scanning direction.

The line sensor 40 is mounted on a carriage 41 via a coil spring (not shown). The carriage 41 is movable in a sub-scanning direction (indicated by arrow 38) by a known belt driving mechanism below the contact glasses 20, 21. The carriage 41 is reciprocated in the sub-scanning direction in parallel with the contact glasses 20, 21 by a drive force outputted from a motor 35 (with reference to FIG. 5).

As shown in FIG. 2, the contact glasses 20, 21 are provided on an upper face of the sheet table 11. When the sheet cover 17 is opened with respect to the sheet table 11, the contact glasses 20, 21 are exposed. When the sheet table 11 is closed with respect to the sheet cover 17, an entirety of the upper face of the sheet table 11 which includes the contact gasses 20, 21 is covered. FIG. 2 shows the scanner 10 in a state in which the entirety of the upper face of the sheet table 11 is covered with the sheet cover 17.

The document sheet is placed on the contact glass 20 where the sheet table 11 is used as the FBS. The contact glass 20 is provided by, e.g., a transparent glass plate or acrylic plate. When the reading of the document sheet is commanded to be started in the state in which the document sheet is placed on the contact glass 20, the carriage 41 is moved in the sub-scanning direction indicated by the arrow 38 while facing to the contact glass 20. In this process, the image formed on the document sheet placed on the contact glass 20 is read by the line sensor 40 through the contact glass 20.

The contact glass 21 functions as a sheet-reading surface when the image formed on the document sheet conveyed by the ADF 28 is read. The contact glass 21 is provided by, e.g., the transparent glass plate or the acrylic plate. The contact glass 21 extends in a depth direction of the scanner 10 (which is perpendicular to the paper sheet surface of FIG. 2) in correspondence with a length of the line sensor 40 in the lain scanning direction. When the reading of the document sheet is commanded to be started in the state in which the document sheet is placed on the sheet holder 30, the carriage 41 is moved such that the line sensor 40 is positioned so as to face to the contact glass 21. The document sheet placed on the sheet holder 30 passes at a specific position located on the contact glass 21 in the process in which the document sheet is conveyed by the ADF 28 along the sheet-convey path 12. The light is emitted to the document sheet from the light sources of the line sensor 40. The light reflected from the document sheet is received by the light-receiving elements of the line sensor 40, and converted to an electric signal. Then, the signal is outputted to a prescribed section of the scanner 10. In this way, the image formed on the document sheet passing through the sheet-convey path 12 is read at the specific position by the line sensor 40 through the contact glass 21.

As shown in FIG. 2, a sheet-press member 16 is provided on a back face of the sheet cover 17. The sheet-press member 16 is disposed at a position facing to the contact glass 20. The sheet-press member 16 is provided by, e.g., a sponge having a plate-like shape. The sheet-press member 16 is for pressing the document sheet placed on the contact glass 20, and is formed so as to cover a portion of a surface of the contact glass 20 which is exposed at the upper face of the sheet table 11. This sheet-press member 16 is all white in order that the line sensor 40 stably receives the light reflected from the document sheet and in order that the same output as white is obtained with respect to an area of the contact glass 20 at which the document sheet is not placed.

As shown in FIG. 1, the sheet cover 17 is provided with a sheet tray 50 and a sheet-discharge tray 51. The sheet tray 50 and the sheet-discharge tray 51 are disposed in a state in which the sheet tray 50 is above the sheet-discharge tray 51. The sheet-discharge tray 51 is constructed integrally with the sheet cover 17. The sheet tray 50 includes a tray body 56 and a pivot tray 52. The pivot tray 52 is pivotable upward relative to the tray body 56. As shown in FIG. 1, the sheet-discharge tray 51 is partly covered with the tray body 56 and the pivot tray 62. The pivot tray 52 is pivoted upward, whereby an upper portion of the sheet-discharge tray 51 is exposed.

Sheet Holder 30

The sheet cover 17 is provided with the sheet holder 30. The document sheet is placed on the sheet holder 30. In this scanner 10, the sheet holder 30 includes the sheet tray 50 and a sheet-supply guide 68. The document sheet placed on the sheet tray 50 is held by the sheet tray 50 and the sheet-supply guide 68. In this scanner 10, as shown in FIG. 3, on the sheet holder 30, there are placed, e.g., a document sheet 81 (first sheet) of A4 size having a width of 210 mm as a first width and a length of 297 mm, a document sheet 83 (third sheet) of B4 size having a width of 257 mm as a third width and a length of 364 mm, and a document sheet 82 (second sheet) of A3 size having a width of 297 mm as a second width and a length of 420 mm. As is apparent from this explanation, the document sheet 82 is wider than the document sheet 81. The document sheet 83 is wider than the document sheet 81 and narrower than the document sheet 82. As thus described, document sheets having various widths can be placed on the sheet holder 30. Each of the document sheets 81-83 is placed on the sheet holder 30 such that a widthwise direction of the document sheet coincides with a direction indicated by arrow 37. Thus, in the following explanation, the widthwise direction of each document sheet 81-83 will be referred to as a widthwise direction 37.

As described above, in this scanner 10, a sheet having the first width is the document sheet 81 of the A4 size, a sheet having the second width is the document sheet 82 of the A3 size, and a sheet having the third width is the document sheet 83 of the B4 size. However, the document sheets 81-83 are respectively examples of the sheets having the first width, the second width, and the third width. Thus, the first width, the second width, the third width may be suitably changed according to document sheets placeable on the sheet holder 30.

As shown in FIGS. 1 and 3, a pair of side guides 53 are provided on the tray body 56 of the sheet tray 50. The side guides 53 are for regulating a position of the document sheet placed on the sheet holder 30 in the widthwise direction 37. The side guides 53 respectively includes plates 47 and side walls 48. Each of the side walls 48 erects on a corresponding one of the plates 47, so that each of the side guides 53 has a generally L shape in its cross section. In the tray body 56, there are formed guide grooves 45 extending in the widthwise direction 37. The plates 47 are respectively supported by the guide grooves 45. Thus, the side guides 53 are slidable relative to the tray body 56 in the widthwise direction 37. The side guides 53 are constructed such that when one of the side guides 53 is slid in a certain direction, the other of the side guides 53 is cooperated to be slid in a direction opposite to the certain direction by an interdependent mechanism 57 (with reference to FIG. 2). It is noted that since the interdependent mechanism 57 is well known, a detailed explanation thereof is dispensed with. Respective positions of the side guides 53 are changed in the widthwise direction 37 according to the width of the document sheet placed on the sheet holder 30. Specifically, in a state in which the document sheet is placed on the sheet holder 30, one of the side guides 53 is slid, whereby the side guides 53 are respectively brought into contact with both of side edges of the document sheet. As a result, regardless of the width of the document sheet placed on the sheet tray 50, the document sheet is regulated such that a center thereof is positioned at a prescribed position.

The sheet holder 30 and the sheet-discharge tray 51 are connected to each other by the sheet-convey path 12. Through the sheet-convey path 12, the document sheet placed on the sheet holder 30 is conveyed. As shown in FIG. 2, the sheet-convey path 12 is formed so as to have a laterally generally U-shape in a vertical cross section. The sheet-convey path 12 is defined by ribs and guide plates constituting a main body of the ADF 28 so as to have a predetermined width such that the document sheet can pass. The document sheet supplied from the sheet holder 30 is conveyed through the sheet-convey path 12 to the sheet-discharge tray 51 while making a U-turn such that the document sheet is turned upside down.

The ADF 28 is provided with a sheet-convey mechanism for conveying the document sheet placed on the sheet holder 30 along the sheet-convey path 12. As shown in FIG. 2, in this scanner 10, there are provided, in the sheet-convey path 12, a sheet-supply roller (a sheet-convey member) 60, a sheet-separate roller 61 partly constituting a separator, a sheet-feed roller 62, pinch rollers 63, 64, a sheet-discharge roller 65, and a pinch roller 66. That is, roller surfaces of these rollers 60-66 are exposed to the sheet-convey path 12.

Sheet-supply Roller 60 and Sheet-separate Roller 61

As shown in FIG. 2, the sheet-supply roller 60 is disposed above the sheet-supply guide 68. The sheet-supply roller 60 is disposed on an upstream side of the sheet-separate roller 61 in a sheet-convey direction 55 perpendicular to the widthwise direction 37 of the document sheet placed on the sheet holder 30. The sheet-supply roller 60 is rotatably provided on a distal end of an arm 70 (with reference to FIG. 2) which is provided on a shaft which coincides with an axis of the sheet-separate roller 61. This arm 70 is pivotable about the axis of the sheet-separate roller 61. Thus, the sheet-supply roller 60 is movable in a vertical direction so as to move toward and away from the sheet-supply guide 68. The arm 70 is pivoted downward in the state in which the document sheet is placed on the sheet holder 30, the sheet-supply roller 60 is brought into contact with a leading end of the document sheet.

As shown in FIG. 2, the sheet-separate roller 61 is provided above the sheet-supply guide 68 on a downstream side of the sheet-supply roller 60 in the sheet-convey direction 55. Further, on a portion of the sheet-supply guide 68 with which the sheet-separate roller 61 is brought into contact, there is provided a sheet-separate pad 69 which partly constitutes the separator and which separates the document sheet owing to friction by nipping or being brought into pressing contact with the roller surface of the sheet-separate roller 61. This sheet-separate pad 69 is disposed side by side with a first position 91 (with reference to FIG. 4) of a first sensor 71 described below in the widthwise direction 37 an the direction perpendicular to the paper sheet surface of FIG. 2). The sheet-separate roller 61 is held in contact with the sheet-separate pad 69. Thus, the leading end of the document sheet which is supported by the sheet-supply guide 68 is stopped by being brought into contact with a nipping portion constituted by the sheet-separate roller 61 and the sheet-separate pad 69. That is, the document sheet (i.e., the document sheets 81-83) is placed on the sheet holder 30 such that the leading end of the document sheet is located on a downstream side of the sheet-supply roller 60 in the sheet-convey direction 55.

Figure 5:
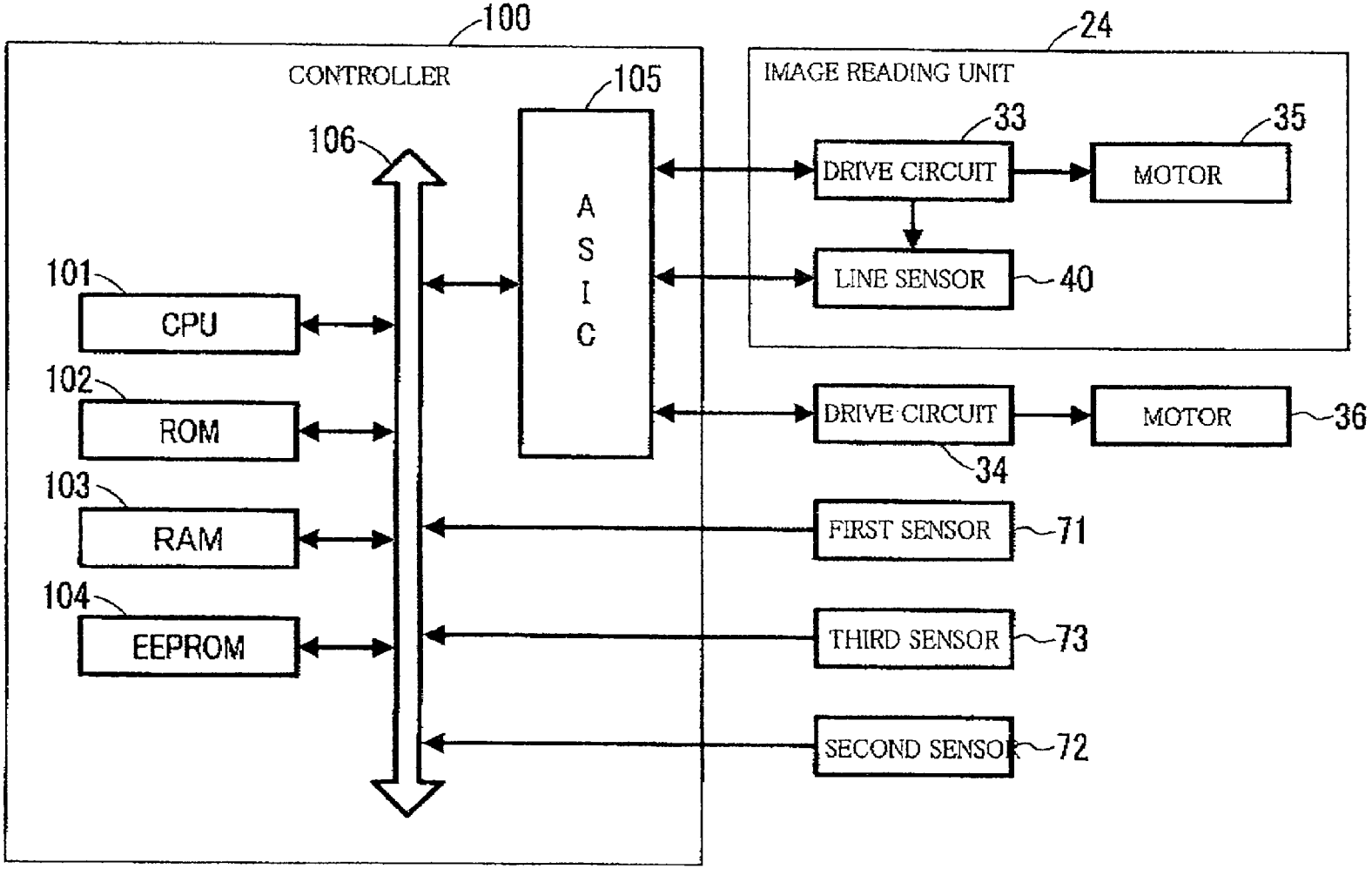
FIG. 5 is a block diagram showing an example of a configuration of a controller 100.

The sheet-supply roller 60 and the sheet-separate roller 61 are driven to be rotated by a drive force of a motor 36 transmitted from the motor 36 (with reference to FIG. 5). Further, the arm 70 is pivoted, by the drive force transmitted from the motor 36, in a direction in which the sheet-supply roller 60 is moved toward and away from the sheet-supply guide 68. The arm 70 is pivoted downward, whereby the sheet-supply roller 60 is brought into pressing contact with the document sheet on the sheet-supply guide 68. The sheet-supply roller 60 is driven to be rotated by the drive force transmitted from the motor 36. As a result, the sheet-supply roller 60 conveys the document sheet placed on the sheet holder 30 in the sheet-convey direction 55.

Sheet-feed Roller 62

The sheet-feed roller 62 is provided on a downstream side of the sheet-separate roller 61 in the sheet-convey path 12. The sheet-feed roller 62 is driven to be rotated by the drive force transmitted from the motor 36. The pinch roller 63 is rotatably provided at a position facing to an upper portion of the roller surface of the sheet-feed roller 62. Further, the pinch roller 64 is rotatably provided at a position facing to a lower portion of the roller surface of the sheet-feed roller 62. Shafts of the pinch rollers 63, 64 are forced toward the sheet-feed roller 62 by respective elastic materials such as springs. As a result, the respective roller surfaces of the pinch rollers 63, 64 are held in pressing contact with the sheet-feed roller 62. Thus, when the sheet-feed roller 62 is driven to be rotated, the pinch rollers 63, 64 are rotated accordingly.

Sheet-discharge Roller 65

The sheet-discharge roller 65 is provided at the most downstream position in the sheet-convey path 12. The sheet-discharge roller 65 is driven to be rotated by the drive force transmitted from the motor 36 like the sheet-supply roller 60, the sheet-separate roller 61, and the sheet-feed roller 62. The pinch roller 66 is provided at a position facing to a lower portion of the roller surface of the sheet-discharge roller 65. A shaft of the pinch roller 66 is forced toward the sheet-discharge roller 66 by an elastic material such as a spring. As a result, the roller surface of the pinch roller 66 is held in pressing contact with the sheet-discharge roller 65.

Operation of Conveying of Document Sheet

As described above, the document sheet is placed on the sheet holder 30 such that the leading end of the document sheet is held in contact with the nipping portion constituted by the sheet-separate roller 61 and the sheet-separate pad 69, with the leading end passed through a position between the sheet-supply guide 68 and the sheet-supply roller 60. Further, the side edges of the document sheet are respectively brought into contact with the side guides 53, whereby the document sheet is disposed such that the center of the document sheet in the widthwise direction 37 generally coincides with a center of the sheet holder 30 in the widthwise direction 37. A position at which the document sheet is placed on the sheet holder 30 while satisfying the above-mentioned two conditions is defined as a predetermined setting position. FIG. 3 shows that the document sheets 81-83 are placed at the predetermined setting position.

In a state in which the document sheet is placed at the predetermined setting position of the sheet holder 30, the drive force of the motor 36 is transmitted to the arm 70. As a result, the arm 70 is pivoted downward, whereby the roller surface of the sheet-supply roller 60 is held in pressing contact with the document sheet on the sheet-supply guide 68. In this state, when the drive force of the motor 36 is transmitted to the sheet-supply roller 60, the document sheet placed on the sheet holder 30 is conveyed in the sheet-convey direction 55 by a rotational force of the sheet-supply roller 60. That is, the document sheet is conveyed beyond the sheet-separate roller 61. As a result, the leading end of the document sheet is inserted into between the sheet-separate pad 69 and the sheet-separate roller 61. The drive force of the motor 36 is also transmitted to the sheet-separate roller 61. When the sheet-separate roller 61 is rotated, the document sheet is conveyed downstream in the sheet-convey direction 55 by a frictional force between the roller surface of the sheet-separate roller 61 and the document sheet. In this time, where a plurality of the document sheets are placed on the sheet holder 30, document sheets except for an uppermost document sheet are stopped by being brought into contact with the sheet-separate pad 69, whereby only the uppermost document sheet is conveyed downstream in the sheet-convey direction 55. As thus described, the document sheets placed on the sheet holder 30 are separated one by one by the sheet-separate roller 61 and the sheet-separate pad 69. The separated uppermost document sheet is conveyed downstream in the sheet-convey path 12 by a rotational force of the sheet-separate roller 61.

The document sheet is inserted into between the sheet-feed roller 62 and the pinch roller 63 while being guided by the sheet-convey path 12. Since the drive force of the motor 36 is transmitted to the sheet-feed roller 62, the document sheet is conveyed further downstream in the sheet-convey path 12 by a rotational force of the sheet-feed roller 62. The document sheet is inserted into between the sheet-feed roller 62 and the pinch roller 64, and then is conveyed to further downstream in the sheet-convey path 12 by the rotational force of the sheet-feed roller 62. As a result, the leading end of the document sheet is brought into contact with a portion constituted by the sheet-discharge roller 65 and the pinch roller 66 at which the rollers 65, 66 are contacted with each other. Since the drive force of the motor 36 is also transmitted to the sheet-discharge roller 65, the document sheet is conveyed downstream in the sheet-convey path 12 by a rotational force of the sheet-discharge roller 65 to be discharged to the sheet-discharge tray 51. In the process of conveying the document sheet, the document sheet passes at the specific position located on the contact glass 21 (with reference to FIG. 2). In this time, the image formed on the document sheet is read by the line sensor 40 disposed below the contact glass 20.

First Sensor 71, Third Sensor 73, Second Sensor 72

Hereinafter, there will be explained the first sensor 71, a third sensor 73, and a second sensor 72 disposed on the sheet-supply guide 68. Each of the first sensor 71, the third sensor 73, and the second sensor 72 is for sensing whether a part of the document sheet placed on the sheet holder 30 is present or absent.

The first sensor 71, the third sensor 73, and the second sensor 72 include respective optical sensors 78 (photo interrupters 78) each of which can transmit a light, and respective light-intercepting members 75, 77, 76 each rotatably supported by a shaft 84. In the sheet-supply guide 68, there are formed openings through which the respective light-intercepting members 75, 77, 76 of the sensors 71, 73, 72 are inserted. As shown in FIG. 2, one of opposite ends of each of the light-intercepting members 75, 77, 76, between which the shaft 84 is interposed, is projected to an upper-side of the sheet-supply guide 68 through a corresponding one of the openings. Further, the other of the opposite ends of each of the light-intercepting members 75, 77, 76 is located on a lower side of the sheet-supply guide 68.

As shown in FIG. 2, the photo interrupter 78 of the first sensor 71 is disposed on a back side of the sheet-supply guide 68 and below the light-intercepting member 75. This photo interrupter 78 includes a light-emitting portion and a light-receiving portion which face to each other in the direction perpendicular to the paper sheet surface of FIG. 2 with a specific distance interposed therebetween. The light-emitting portion emits a light while the light-receiving portion receives the light emitted from the light-emitting portion. The first sensor 71 outputs, to a predetermined section of this scanner 10, a sensor signal according to an intensity of the light received by the light-receiving portion of the photo interrupter 78. A light-intercepting plate portion 88 is provided on the other end of the light-intercepting member 75. The light-intercepting plate portion 88 is provided so as to advance to and retract from a position between the light-emitting portion and the light-receiving portion. As shown in FIG. 2, in a state in which an external force is not applied to the light-intercepting member 75, a light passing through a light path between the light-emitting portion and the light-receiving portion is intercepted by the light-intercepting plate portion 88. Thus, the light emitted from the light-emitting portion is not received by the light-receiving portion. That is, the first sensor 71 is in an OFF state. The document sheet placed on the sheet holder 30 is brought into contact with the light-intercepting member 75, whereby the light-intercepting member 75 is pivoted. As a result, the light-intercepting plate portion 88 is moved upward so as to be moved away from the position at which the light passing through the light path of the photo interrupter 78 is intercepted. Consequently, the light emitted from the light-emitting portion is received by the light-receiving portion, whereby the first sensor 71 becomes an ON state.

Figure 4:
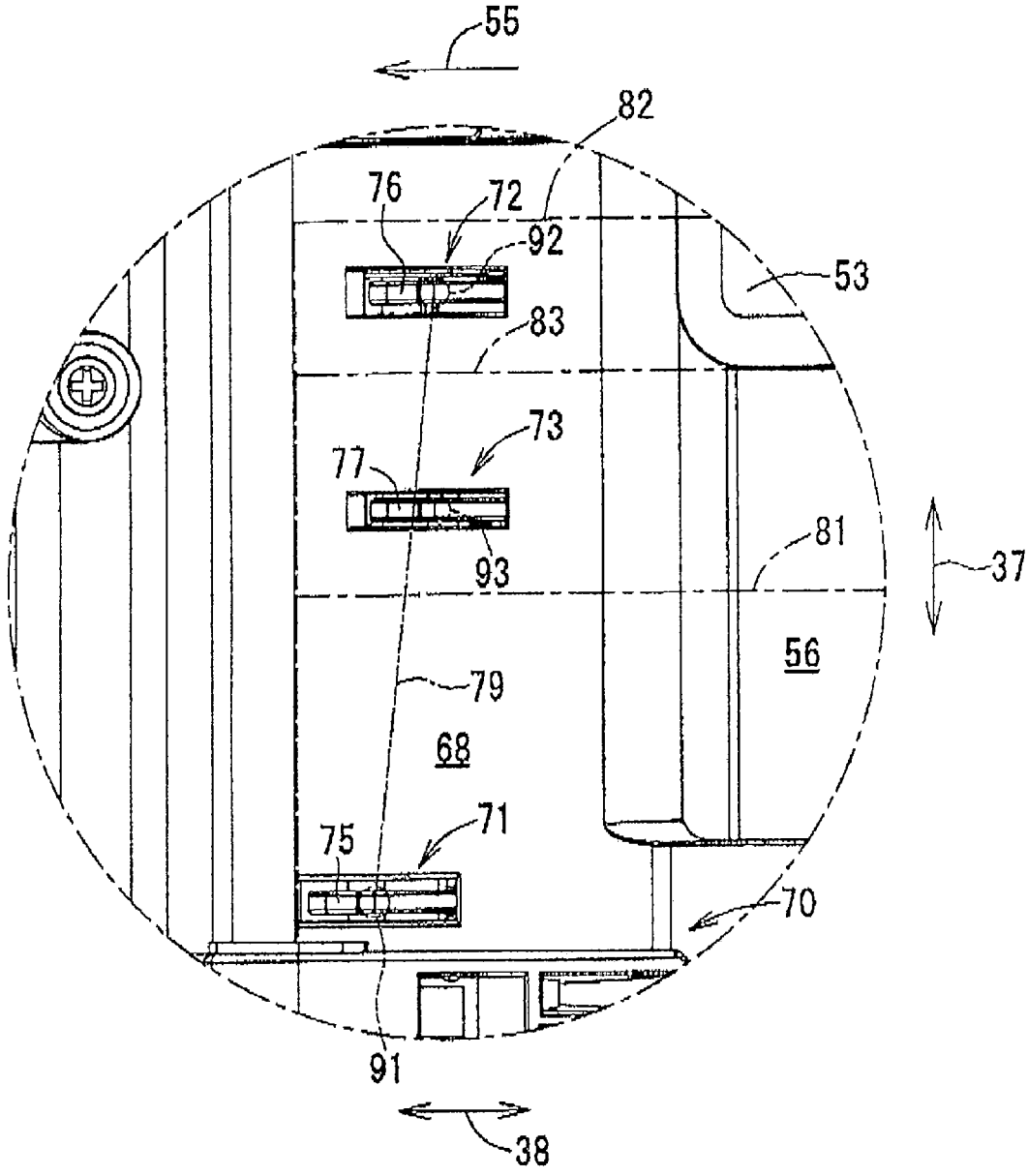
FIG. 4 is an enlarged view showing a portion of the scanner 10 which is indicated by "IV" in FIG. 3.

It is noted that the light-intercepting member 77 (with reference to FIG. 4) of the third sensor 73 and the light-intercepting member 76 (with reference to FIG. 4) of the second sensor 72 have the same construction of the light-intercepting member 75 (with reference to FIGS. 2 and 4). That is, a light-intercepting plate portion 90 is provided on the other of opposite ends of the light-intercepting member 77, between which the shaft 84 is interposed. A light-intercepting plate portion 89 is provided on the other of opposite ends of the light-intercepting member 76, between which the shaft 84 is interposed. Further, below the light-intercepting member 77 and the light-intercepting member 76, there are provided the respective photo interrupters 78 each of which is the same as that of the first sensor 71. That is, the light-intercepting member 77 is pivoted, whereby a light passing through a light path of the photo interrupter 78 of the third sensor 73 is interrupted or opened by the light-intercepting plate portion 90. The light-intercepting member 76 is pivoted, whereby a light passing through a light path of the photo interrupter 78 of the second sensor 72 is interrupted or opened by the light-intercepting plate portion 89. The document sheet is brought into contact with one of the opposite ends of each of the light-intercepting members 77, 76, whereby each of the light-intercepting members 77, 76 is pivoted like the light-intercepting member 75. Thus, respective changes of states of the third sensor 73 and the second sensor 72 are the same that of the first sensor 71, and thus explanations thereof are omitted.

The first sensor 71 is disposed at the first position 91 (with reference to FIG. 4) of the sheet-supply guide 68 of the sheet holder 30. The first position 91 in this scanner 10 is located at a position at which the leading end of the document sheet placed on the sheet holder 30 is brought into contact with the light-intercepting member 75 of the first sensor 71. The first sensor 71 is disposed on an inside of or (within (under in FIG. 4) the A4 size document sheet 81 placed at the predetermined setting position in the widthwise direction 37. That is, the first position 91 is set so as to be positioned on an inside of or within the first width (the width of the document sheet 81 in this scanner 10) in the widthwise direction 37 of the document sheet in the state in which the document sheet is placed at the predetermined setting position.

Further, as shown in FIG. 2, the first sensor 71 is disposed on a downstream side of the sheet-supply roller 60 in the sheet-convey direction 55. That is, the first position 91 is set so as to be located on the downstream side of the sheet-supply roller 60 as the sheet-convey member in the sheet-convey direction 55. Thus, on the basis of whether a part of a document sheet is sensed or not by the first sensor 71, whether any document sheet can be conveyed by the sheet-supply roller 60 or not can be judged. Specifically, where any part of a document sheet is not sensed by the first sensor 71 in spite that the document sheet is in a state of being placed on the sheet holder 30, there is a possibility that the leading end of the document sheet is located on an upstream side of the sheet-supply roller 60 in the sheet-convey direction 55. Thus, there is judged that the document sheet cannot be conveyed by the sheet-supply roller 60. Where the first sensor 71 has sensed a part of a document sheet, the leading end of the document sheet is located on a downstream side of the sheet-supply roller 60 in the sheet-convey direction 55. Thus, there is judged that the document sheet can be conveyed by the sheet-supply roller 60.

The third sensor 73 is disposed at a third position 93 (with reference to FIG. 4) of the sheet-supply guide 68 of the sheet holder 30. The third position 93 in this scanner 10 is located at a position at which the leading end of the document sheet placed on the sheet holder 30 is brought into contact with the light-intercepting member 77 of the third sensor 73. As shown in FIG. 4, the third sensor 73 is disposed on an outside of the A4 size document sheet 81 placed at the predetermined setting position in the widthwise direction 37 and on an inside of the B4 size document sheet 83 placed at the predetermined setting position in the widthwise direction 37. That is, in the widthwise direction 37, the third position 93 is set so as to be positioned on an outside of the first width (the width of the document sheet 81 in this scanner 10) and on an inside of the third width (the width of the document sheet 83 in this scanner 10) in the state in which a document sheet is placed at the predetermined setting position.

Further, as shown in FIG. 4, the third sensor 73 is disposed on an upstream side, in the sheet-convey direction 55, of a line segment 79 connecting the first sensor 71 and the second sensor 72. That is, the third position 93 is set so as to be located on the upstream side, in the sheet-convey direction 55, of the line segment 79 connecting the first position 91 at which the first sensor 71 is disposed and a second position 92 (with reference to FIG. 4) at which the second sensor 72 is disposed.

The second sensor 72 is disposed at the second position 92 of the sheet-supply guide 68 of the sheet holder 30. The second position 92 in this scanner 10 is located at a position at which the leading end of the document sheet placed on the sheet holder 30 is brought into contact with the light-intercepting member 76 of the second sensor 72. As shown in FIG. 4, the second sensor 72 is disposed on an outside of the B4 size document sheet 83 placed at the predetermined setting position and on an inside of the A3 size document sheet 82 placed at the predetermined setting position. That is, in the widthwise direction 37, the second position 92 is set so as to be positioned on an outside of the first width (the width of the document sheet 81 in this scanner 10) in the state in which a document sheet is placed at the predetermined setting position. More specifically, in the widthwise direction 37, the second position 92 is set so as to be positioned on an outside of the third width (the width of the document sheet 83 in this scanner 10) and on an inside of the second width (the width of the document sheet 82) in the state in which a document sheet is placed at the predetermined setting position.

The second sensor 72 is disposed on an upstream side of the first sensor 71 in the sheet-convey direction 55 and on a position generally the same in the sheet-convey direction 55 as a position at which the third sensor 73 is disposed. That is, in the sheet-convey direction 55, the second position 92 at which the second sensor 72 is disposed is set so as to be located on an upstream side of the first position 91 at which the first sensor 71 is disposed. Further, in the sheet-convey direction 55, the second position 92 is set so as to be located at a position generally the same as the third position 93 at which the third sensor 73 is disposed.

Controller 100

There will be next explained a general configuration of a controller 100 with reference to FIG. 5.

The controller 100 executes controls over entire operations of the scanner 10. As shown in FIG. 5, the controller 100 is configured as a microcomputer mainly including a CPU 101, a ROM 102, a RAM 103, an EEPROM 104, and an Application Specific Integrated Circuit (ASIC) 105. The CPU 101, the ROM 102, the RAM 103, the EEPROM 104, and the ASIC 105 are connected to each other via a bus 106 so as to be communicated with each other.

In the ROM 102, there are stored programs for controlling an image reading unit 24 (with reference to FIG. 5) and so on by the CPU 101. The RAM 103 is used as a storing area for temporarily storing various data used when the CPU 101 executes the programs, and used as a working area for data processings and so on. The EEPROM 104 stores settings, flags, and so on which are to be kept or held after the scanner 10 is turned off.

To the ASIC 105, the image reading unit 24 is connected. The image reading unit 24 performs reading of the document sheet and outputs the image formed on the document sheet as an image signal. The image reading unit 24 includes a drive circuit 33, the motor 35, and the line sensor 40. The drive circuit 33 energizes the motor 35 by transmitting a drive signal thereto on the basis of a phase excitation signal or the like inputted from the ASIC 105. The motor 35 is a stepping motor, for example. The motor 35 is rotated by the drive signal received from the drive circuit 33. As a result, the carriage 41 is moved. Further, the drive circuit 33 also performs adjustment of an operating current and the like for controlling a light source of the line sensor 40 to light up.

To the ASIC 105, a drive circuit 34 is connected. The drive circuit 34 drives the motor 36. The motor 36 is a drive source of the ADF 28 and is rotatable forwardly and reversely. The drive circuit 34 produces a pulse signal for rotating the motor 36 on the basis of an outputting signal from the ASIC 105. On the basis of the pulse signal, the motor 36 is driven to be rotated. The motor 36 is connected to the sheet-supply roller 60, the sheet-separate roller 61, the sheet-feed roller 62, and the sheet-discharge roller 65 via a drive-force transmitting mechanism, not shown. The motor 36 is driven in the state in which the document sheet is placed on the sheet holder 30. As a result, the sheet-supply roller 60, the sheet-separate roller 61, the sheet-feed roller 62, and the sheet-discharge roller 65 are driven to be rotated, whereby the document sheet is conveyed along the sheet-convey path 12.

To the controller 100, there are connected the first sensor 71, the third sensor 73, and the second sensor 72 via a sensor-input circuit, not shown. The sensor signals outputted from the sensors 71-73 are transmitted to the controller 100 after noise of the sensor signals are removed by the sensor-input circuit.

As described above, the first sensor 71 is disposed at the first position 91 (with reference to FIG. 4) of the sheet-supply guide 68. Thus, the controller 100 can sense the presence and absence of a part of the document sheet at the first position 91 on the basis of the sensor signal outputted from the first sensor 71. Further, as described above, the third sensor 73 is disposed at the third position 93 (with reference to FIG. 4) of the sheet-supply guide 68. Thus, the controller 100 can sense the presence and absence of a part of the document sheet at the third position 93 on the basis of the sensor signal outputted from the third sensor 73. Further, as described above, the second sensor 72 is disposed at the second position 92 (with reference to FIG. 4) of the sheet-supply guide 68. Thus, the controller 100 can sense the presence and absence of a part of the document sheet at the second position 92 on the basis of the sensor signal outputted from the second sensor 72. It is noted that since the sheet-separate pad 69 is disposed side by side with the first position 91 in the widthwise direction 37, where the plurality of the document sheets are placed on the sheet holder 30, the controller 100 can judge, on the basis of a result of the sensing of the first sensor 71, whether these document sheets have reached to a position at which the document sheets are to be separated.

Image Reading

Figure 6:
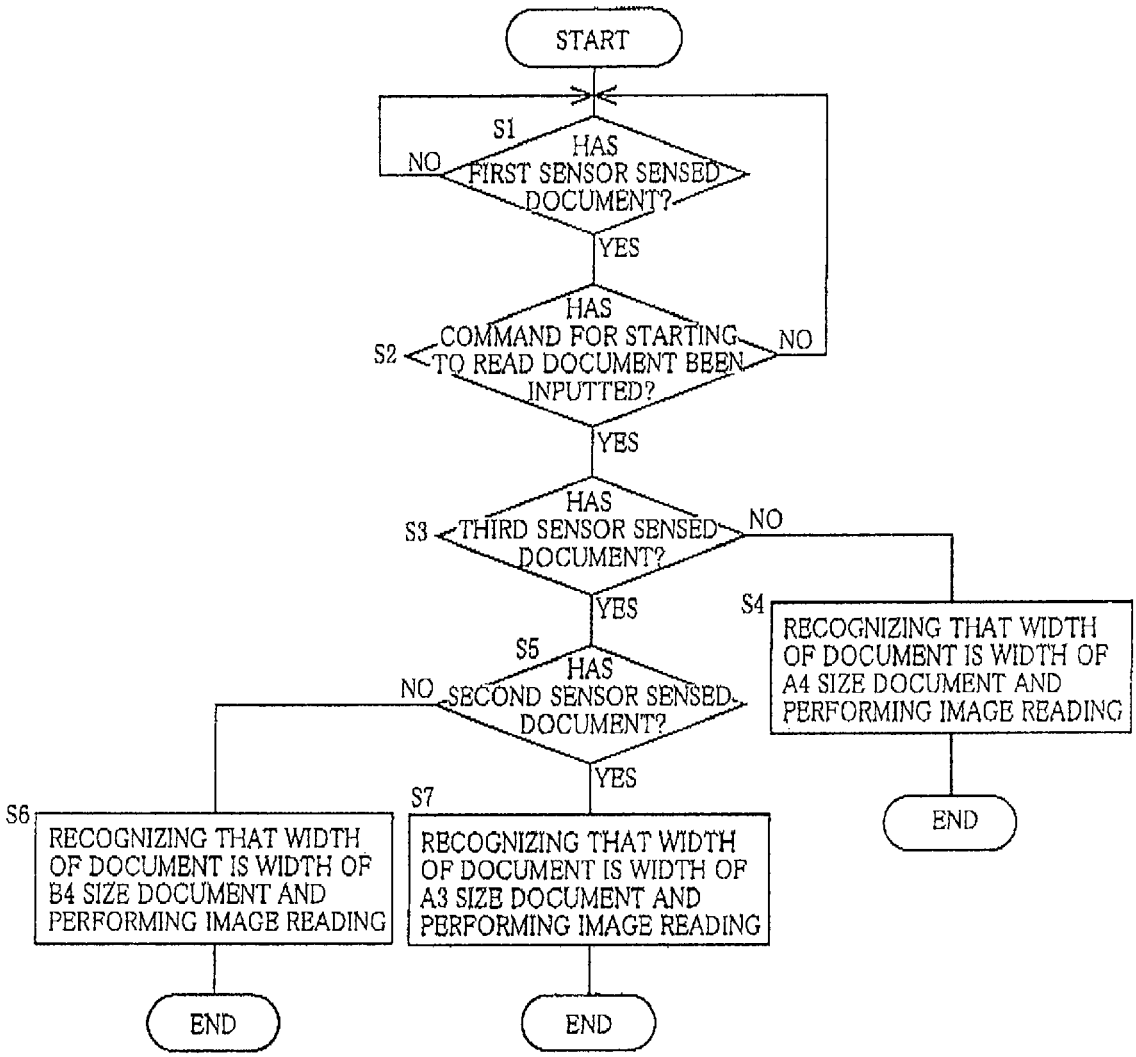
FIG. 6 is a flow-chart showing an example of a procedure of a processing of the scanner 10 which is performed by the controller 100 where a document sheet is placed on a sheet holder 30.

Hereinafter, there will be explained, with reference to a flow-chart in FIG. 6, a procedure of a processing executed by the scanner 10 where a document sheet has been placed on the sheet holder 30. It is noted that, the processing of the scanner 10 to be explained on the basis of the flow-chart in FIG. 6 is executed according to a command outputted from the controller 100 on the basis of the program stored in the ROM 102.

In S1, the controller 100 judges, on the basis of the sensor signal outputted from the first sensor 71, whether the first sensor 71 has sensed a part of a document sheet or not. That is, the controller 100 judges whether the first sensor 71 is in the OFF state in which the first sensor 71 has not sensed any part of a document sheet or in the ON state in which the first sensor 71 is sensing the part of the document sheet. As described above, this first sensor 71 is disposed at the first position 91. Thus, where an A4 size document sheet 81 is placed at the predetermined setting position of the sheet holder 30, the document sheet 81 is brought into contact with the light-intercepting member 75 of the first sensor 71, whereby the light-intercepting member 75 is pivoted. Where a B4 size document sheet 83 is placed at the predetermined setting position of the sheet holder 30, the document sheet 83 is brought into contact with the light-intercepting member 76, whereby the light-intercepting member 75 is pivoted. Where an A3 size document sheet 82 is placed at the predetermined setting position of the sheet holder 30, the document sheet 82 is brought into contact with the light-intercepting member 75, whereby the light-intercepting member 75 is pivoted. As thus described, even where any of the document sheets 81-83 is placed at the predetermined setting position of the sheet holder 30, the light-intercepting member 75 of the first sensor 71 is pivoted, whereby the state of the first sensor 71 is changed from the OFF state to the ON state. Thus, the controller 100 judges the presence and absence of a document sheet placed on the sheet holder 30 on the basis of the sensor signal outputted from the first sensor 71.

In S1, where the controller 100 has judged that the first sensor 71 has not sensed any part of a document sheet (S1: NO), that is, where the controller 100 has judged that the first sensor 71 stays in the OFF state, the controller 100 waits for the first sensor 71 to sense the part of the document sheet.

Where the controller 100 has judged that the first sensor 71 has sensed a part of a document sheet (S1: YES), that is, where the controller 100 has judged that the first sensor 71 is in the ON state, the controller 100 judges, in 82, whether the command for starting to read an image formed on the document sheet has been inputted or not. Specifically, the controller 100 judges whether the command for starting to read the image formed on the document sheet is inputted through the operational panel (not shown) or not, that is, judges whether a start button is pushed or not, for example. Where the controller 100 has judged that the command for starting to read the image formed on the document sheet has not been inputted (S2: NO), the processing returns to S1.

Where the controller 100 has judged that the command for starting to read the document sheet has been inputted (S2: YES), the third sensor 73 judges, in S3, whether the document sheet has been sensed or not. Specifically, the controller 100 judges whether the third sensor 73 is in the ON state or in the OFF state on the basis of the sensor signal outputted from the third sensor 73. As described above, this third sensor 73 is disposed at the third position 93. Thus, where the document sheet placed on the sheet holder 30 is an A4 size document sheet 81, the document sheet 81 is not brought into contact with the light-intercepting member 77 of the third sensor 73. Where the document sheet placed on the sheet holder 30 is a B4 size document sheet 83, the document sheet 83 is brought into contact with the light-intercepting member 77, whereby the light-intercepting member 77 is pivoted. Where the document sheet placed on the sheet holder 30 is an A3 size document sheet 82, the document sheet 82 is brought into contact with the light-intercepting member 77, whereby the light-intercepting member 75 is pivoted. That is, where the third sensor 73 has not sensed a part of the document sheet, the controller 100 judges that the width of the document sheet placed on the sheet holder 30 is the first width (the width of the A4 size document sheet 81 in this scanner 10). Further, where the third sensor 73 has sensed a part of the document sheet, the controller 100 judges that the width of the document sheet placed on the sheet holder 30 is the third width (the width of the B4 size document sheet 83 in this scanner 10) or the second width (the width of the A3 size document sheet 82 in this scanner 10).

Where the controller 100 has judged that the third sensor 73 has not sensed any part of the document sheet (S3: NO), that is, the controller 100 has judged that the third sensor 73 is in the OFF state, the processing goes to S4 in which the controller 100 recognizes that the width of the document sheet placed on the sheet holder 80 is the width of the A4 size document sheet 81 and performs image reading. Specifically, the controller 100 controls the ADF 28 to convey the document sheet along the sheet-convey path 12. Then, when the document sheet is conveyed on the contact glass 21, the controller 100 controls the line sensor 40 to perform the image reading for only an area which corresponds to the width of the A4 size document sheet 81. The document sheet subjected to the image reading by the line sensor 40 is discharged from the sheet-convey path 12 onto the sheet-discharge tray 51.

Where the controller 100 has judged that the third sensor 73 has sensed a part of the document sheet (S3: YES), that is, the controller 100 has judged that the third sensor 73 is in the ON state, the processing goes to S5 in which the controller 100 judges whether the second sensor 72 is sensing a part of the document sheet. Specifically, the controller 100 judges whether the second sensor 72 is in the ON state or in the OFF state on the basis of the sensor signal outputted from the second sensor 72. As described above, this second sensor 72 is disposed at the second position 92. Thus, where the document sheet placed on the sheet holder 30 is a B4 size document sheet 83, the document sheet 83 is not brought into contact with the light-intercepting member 76 of the second sensor 72. Where the document sheet placed on the sheet holder 30 is an A3 size document sheet 82, the document sheet 82 is brought into contact with the light intercepting member 76, whereby the light-intercepting member 76 is pivoted. That is, where the second sensor 72 has not sensed any part of the document sheet, the controller 100 judges that the width of the document sheet placed on the sheet holder 30 is the third width (the width of the B4 size document sheet 83 in this scanner 10). Further, where the second sensor 72 has sensed a part of the document sheet, the controller 100 judges that the width of the document sheet placed on the sheet holder 30 is the second width (the width of the A3 size document sheet 82 in this scanner 10).

Where the controller 100 has judged that the second sensor 72 has not sensed any part of the document sheet (S5: NO), that is, the controller 100 has judged that the second sensor 72 is in the OFF state, the processing goes to S6 in which the controller 100 recognizes that the width of the document sheet is the width of the B4 size document sheet 83 and performs the image reading. Specifically, the controller 100 controls the ADF 28 to convey the document sheet along the sheet-convey path 12. Then, when the document sheet is conveyed on the contact glass 21, the controller 100 controls the line sensor 40 to perform the image reading for only an area which corresponds to the width of the B4 size document sheet 83. The document sheet subjected to the image reading by the line sensor 40 is discharged from the sheet-convey path 12 onto the sheet-discharge tray 51.

Where the controller 100 has judged that the second sensor 72 has sensed a part of the document sheet (S5: YES), that is, the controller 100 has judged that the second sensor 72 is in the ON state, the processing goes to S7 in which the controller 100 recognizes that the width of the document sheet is the width of the A3 size document sheet 82 and performs the image reading. Specifically, the controller 100 controls the ADF 28 to convey the document sheet along the sheet-convey path 12. Then, when the document sheet is conveyed on the contact glass 21, the controller 100 controls the line sensor 40 to perform the image reading for only an area which corresponds to the width of the A3 size document sheet 82. The document sheet subjected to the image reading by the line sensor 40 is discharged from the sheet-convey path 12 onto the sheet-discharge tray 51.

As thus described, where the controller 100 has judged that a part of a document sheet is present at the first position 91 on the basis of the result of the sensing of the first sensor 71, the controller 100 recognizes the width of the document sheet on the basis of the results of the sensings of the third sensor 73 and the second sensor 72, and controls such that the image reading is performed.

In view of the above-described processing, the ADF 28 can be considered to include a sheet-width recognizer configured to recognize the width of the document sheet. The sheet-width recognizer can be considered to include the controller 100, the first sensor 71, the second sensor 72, and the third sensor 73. Further, the sheet-width recognizer can be considered to include, at the controller 100, a sheet placing judging portion configured to judge whether any document sheet is placed on the sheet holder 30 or not on the basis of the result of the sensing of the first sensor 71, and the sheet-width recognizer, that is, the controller 100 can be configured to recognize the width of the document sheet on the basis of the results of the sensings of the second sensor 72 and the third sensor 73 where the sheet placing judging portion has judged that a document sheet is placed on the sheet holder 30. A portion of the controller 100 which executes S3-S7 can be considered to function as the sheet-width recognizer, and a portion of the controller 100 which executes S1 can be considered to function as the sheet-placing judging portion.

Figure 7:
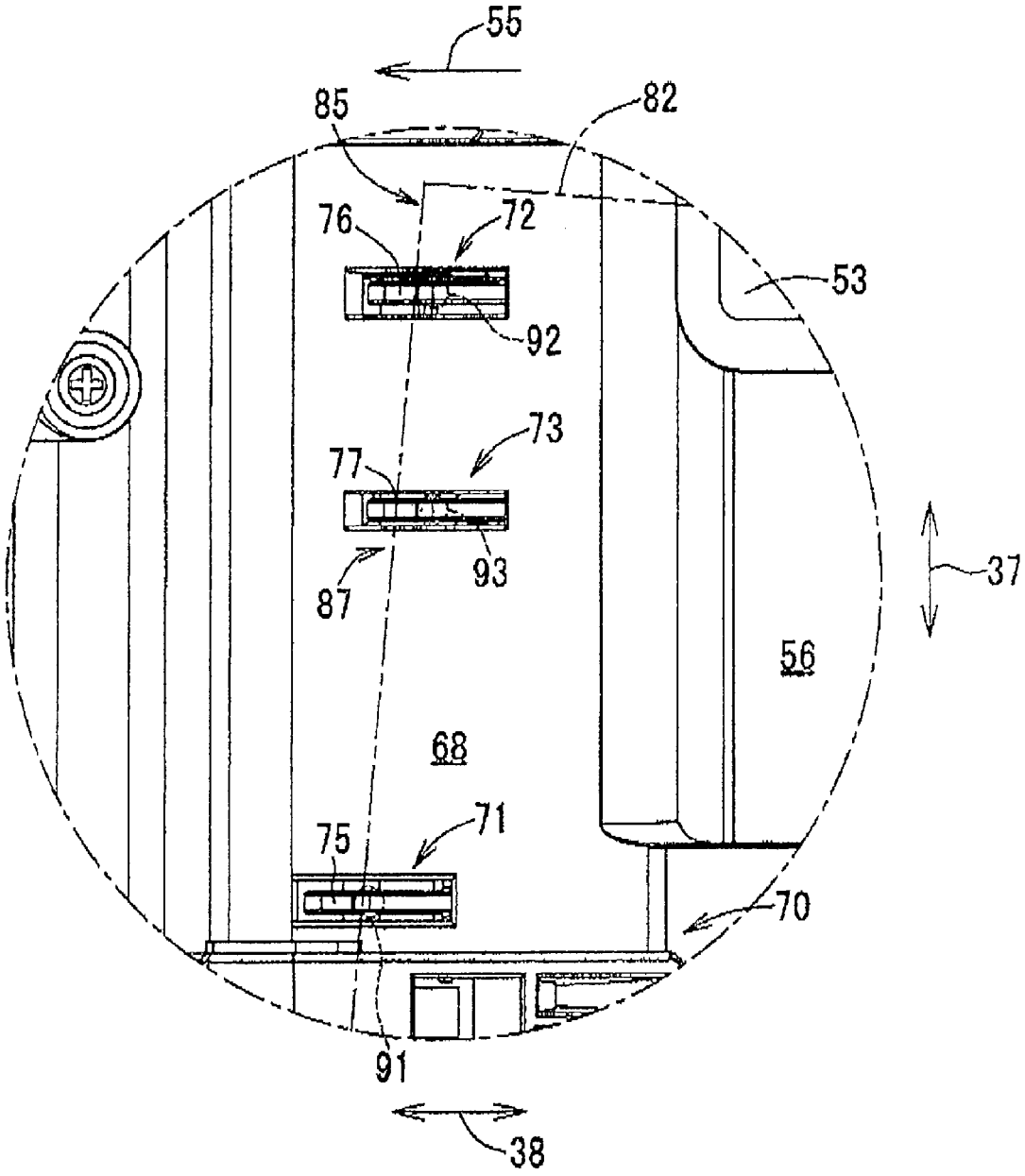
FIG. 7 is an enlarged view showing the portion of the scanner 10 which is indicated by "IV" in FIG. 3 in a state in which a document sheet 82 is obliquely placed.

There will be next explained, with reference to FIG. 7, a sensing of a document sheet which is obliquely placed relative to the predetermined setting position of the sheet holder 30.

Where a document sheet is placed on the sheet holder 30, initially, the pair of side guides 53 are slid outward in the widthwise direction 37, so as to be positioned at the respective positions corresponding to the A3 size document sheet 82. For example, where a distance between the side guides 53 is equal to the width of the A3 size document sheet 82, the document sheet cannot be smoothly placed on the sheet holder 30. Thus, in a state in which the side guides 53 are positioned such that the distance between the side guides 53 is larger than the width of the A3 size document sheet 82, the document sheet is placed on the sheet holder 30. In this case, as shown in FIG. 7, the document sheet 82 placed on the sheet holder 30 may be oblique relative to the predetermined setting position of the sheet holder 30.

As described above, as shown in FIG. 4, the second position 92 is set so as to be located on the upstream side of the first position 91 in the sheet-convey direction 55. Specifically, the second sensor 72 is disposed on the upstream side of the first sensor 71 in the sheet-convey direction 55. Thus, as shown in FIG. 7, even where the A3 size document sheet 82 is obliquely placed on the sheet holder 30, and a corner portion 85 of the leading end of the document sheet 82 is deviated upstream relative to the predetermined setting position in the sheet-convey direction 55, the corner portion 85 is sensed by the second sensor 72.

Further, as described above, as shown in FIG. 4, the third position 93 is set so as to be located on the upstream side, in the sheet-convey direction 55, of the line segment 79 connecting the first position 91 and the second position 92. Specifically, the third sensor 73 is disposed on the upstream side of the line segment 79 in the sheet-convey direction 55. Thus, even where the A3 size document sheet 82 is obliquely placed on the sheet holder 30, and an edge 87 of the leading end of the document sheet 82 is deviated upstream in the sheet-convey direction 55 compared with a case in which the document sheet is properly placed such that an edge thereof in the widthwise direction of the document sheet coincides with a direction perpendicular to the sheet-convey direction 55, the edge 87 is sensed by the third sensor 73.

Effects of Scanner 10

As described above, the second sensor 72 is disposed on the upstream side of the first sensor 71 in the sheet-convey direction 55. Even where the A3 size document sheet 82 is obliquely placed on the sheet holder 30, and the corner portion 85 is deviated upstream in the sheet-convey direction 55, the corner portion 85 is sensed by the second sensor 72. Thus, there can be reduced occurrence of a failure of the sensing of the width of the document sheet caused because the document sheet is obliquely placed.

Further, in this scanner 10, the third sensor 73 is disposed on the upstream side of the line segment 79 in the sheet-convey direction 55. Thus, even where the B4 size document sheet 83 is obliquely placed, and the edge 87 of the leading end of the document sheet 83 is deviated upstream in the sheet-convey direction 55, the edge 87 can be sensed by the third sensor 73. Thus, there can be prevented occurrence of problems such as a failure that the document sheet 82 is sensed by the first sensor 71 and the second sensor 72, and is not sensed by the third sensor 73 in spite that the A3 size document sheet 82 is in the state of being placed.

Further, in this scanner 10, the first sensor 71 is disposed on the downstream side of the sheet-supply roller 60 in the sheet-convey direction 55. Thus, on the basis of the result of the sensing of the first sensor 71, the controller 100 can judge whether the conveying of a document sheet placed on the sheet holder 30 is permitted or not. Further, in this scanner 10, the first sensor 71 and the sheet-separate pad 69 (i.e., the part of the separator) are arranged side by side in the widthwise direction 37. Thus, as described above, on the basis of the result of the sensing of the first sensor 71, even where the plurality of the document sheets are placed on the sheet holder 30, the controller 100 can judge whether the document sheets have been reached to a position at which the document sheets can be separated. Where the controller 100 has judged that the document sheets have been reached to the position, the document sheets are separated one by one by the nipping portion constituted by the sheet-separate roller 61 and the sheet-separate pad 69. That is, where the controller 100 has judged that the conveying of the document sheet is permitted on the basis of the result of the sensing of the first sensor 71, the document sheets are separated one by one by the sheet-separate roller 61 and the sheet-separate pad 69.

It is noted that there has been explained the scanner 10 in which the sheet-convey member is the sheet-supply roller 60. However, the sheet-convey member is not limited thereto. The sheet-convey member may be a sheet-convey belt which conveys a sheet placed on the sheet holder.

Further, there has been explained the scanner 10 in which the three sensors, i.e., the first sensor 71, the third sensor 73, and the second sensor 72, are provided on the sheet holder 30. However) the number of the sensors disposed on the sheet holder 30 is not limited to three. For example, only the first sensor 71 and the second sensor 72 may be provided on the sheet holder 30. In this case, where the controller 100 has judged that a document sheet is present on the basis of the result of the sensing of the first sensor 71, the controller 100 recognizes the width of the document sheet on the basis of the result of the sensing of the second sensor 72. The number of the sensors disposed on the downstream side of the sheet-supply roller 60 may be suitably changed according to a number of types of the document sheets whose widths are different from each other and which are placed on the sheet holder 30.

In this scanner 10, as described above, the sensors 71, 72, 73 are provided by optical sensors, but may be provided by mechanical sensors.

Further, there has been explained a case in which the sheet-convey device is applied to the scanner 10. However, the sheet-convey device may be applied to a sheet-convey device which conveys a recording sheet placed on a manual sheet-supply tray in a printer.

What is claimed is:

1. A sheet-convey device, comprising:

a sheet holder on which a first sheet having a first width is placeable at a predetermined setting position and on which a second sheet having a second width larger than the first width is placeable at the predetermined setting position;

a sheet-convey member configured to convey a sheet placed on the sheet holder in a predetermined sheet-convey direction perpendicular to a widthwise direction of the sheet;

a sheet-width recognizer configured to recognize a width of the sheet;

wherein the sheet-width recognizer includes (a) a first sensor for sensing whether a part of the sheet is present or absent at a first position of the sheet holder and (b) a second sensor for sensing whether a part of the sheet is present or absent at a second position of the sheet holder;

wherein the first position is set so as to be located on an inside of the first width in the widthwise direction in a state in which the first sheet is placed on the sheet holder, while the second position is set so as to be located on an outside of the first width in the widthwise direction in the state in which the first sheet is placed on the sheet holder and on an inside of the second width in the widthwise direction in the state in which the second sheet is placed on the sheet holder; and wherein the second position is set so as to be located on an upstream side of the first position in the sheet-convey direction.

2. The sheet-convey device according to claim 1, wherein where a part of a sheet placed on the sheet holder has been sensed only by the first sensor, the sheet-width recognizer recognizes that a width of the sheet is the first width, and wherein where parts of a sheet placed on the sheet holder have been respectively sensed by the first sensor and the second sensor, the sheet-width recognizer recognizes that a width of the sheet is the second width.

3. The sheet-convey device according to claim 1, wherein a third sheet having a third width larger than the first width and smaller than the second width is placeable at the predetermined setting position, wherein the sheet-width recognizer includes a third sensor for sensing whether a part of the sheet is present or absent at a third position of the sheet holder, wherein the third position is set so as to be located on the outside of the first width in the widthwise direction in the state in which the first sheet is placed on the sheet holder, and on an inside of the third width in the widthwise direction in a state in which the third sheet is placed on the sheet holder, wherein the second position is set so as to be located on an outside of the third width in the widthwise direction in the state in which the third sheet is placed on the sheet holder, and wherein the third position is set so as to be located on an upstream side of a line segment connecting the first position and the second position, in the sheet-convey direction.

4. The sheet-convey device according to claim 3, wherein where a part of a sheet placed on the sheet holder has been sensed only by the first sensor, the sheet-width recognizer recognizes that a width of the sheet is the first width, wherein where parts of a sheet placed on the sheet holder have been respectively sensed only by the first sensor and the third sensor, the sheet-width recognizer recognizes that a width of the sheet is the third width, and wherein where parts of a sheet placed on the sheet holder has been respectively sensed by the first sensor, the second sensor, and the third sensor, the sheet-width recognizer recognizes that a width of the sheet is the second width.

5. The sheet-convey device according to claim 3, wherein the sheet-width recognizer includes a sheet placing judging portion configured to judge whether any sheet is placed on the sheet holder or not on the basis of a result of the sensing of the first sensor, and is configured to recognize, where the sheet placing judging portion has judged that a sheet is placed on the sheet holder, a width of the sheet on the basis of results of the sensings of the third sensor and the second sensor.

6. The sheet-convey device according to claim 3
wherein the second position is substantially the same as the third position in the sheet-convey direction, and
wherein each of the second position and the third position is located on an upstream side of the first position in the sheet-convey direction.

7. The sheet-convey device according to claim 3
wherein the first sensor is configured to sense whether a part is present or absent at a first area of the sheet holder, the first area being elongated in the sheet-convey direction,
wherein the second sensor is configured to sense whether a part of the sheet is present or absent at a second area of the sheet holder, the second area being in the sheet-convey direction, and
wherein the third sensor is configured to sense whether a part of the sheet is present or absent at a third area of the sheet holder, the third area being elongated in the sheet-convey direction.

8. The sheet-convey device according to claim 7
wherein a downstream end of third area is located on an upstream side of a line segment connecting a downstream end of the first area and a downstream end of the second area, in the sheet-convey direction.

9. The sheet-convey device according to claim 7
wherein a position of a downstream end of the second area is substantially the same as that of a downstream end of the third area in the sheet-convey direction, and
wherein each of the downstream end of the second area and the downstream end of the third area is located on an upstream side of a downstream end of the first area in the sheet-convey direction.

10. The sheet-convey device according to claim 1,
wherein the sheet-width recognizer includes a sheet placing judging portion configured to judge whether any sheet is placed on the sheet holder or not on the basis of a result of the sensing of the first sensor, and is configured to recognize, where the sheet placing judging portion has judged that a sheet is placed on the sheet holder, a width of the sheet on the basis of a result of the sensing of the second sensor.

11. The sheet-convey device according to claim 1,
wherein the first position is set so as to be located on a downstream side of the sheet-convey member in the sheet-convey direction.

12. The sheet-convey device according to claim 1, further comprising a separator configured to separate sheets placed on the sheet holder one by one,
wherein the separator is disposed side by side with the first position in the widthwise direction of the sheet.

13. The sheet-convey device according to claim 1, further comprising a side guide provided on the sheet holder so as to be movable in the widthwise direction and to be contacted with a side edge of the sheet placed on the sheet holder.

14. An image reading device, comprising:
the sheet-convey device according to claim 1;
a sheet-convey path through which the sheet placed on the sheet holder is conveyed by the sheet-convey device; and
a line sensor configured to read, at a specific position of the sheet-convey path, an image formed on the sheet being passed through the sheet-convey path.

15. The sheet-covey device according to claim 1,
wherein the first sensor is configured to sense whether a part of the sheet is present or absent at first area of the sheet holder, the first area being elongated in the sheet-convey direction, and
wherein the second sensor is configured to sense whether a part of the sheet is present or absent at a second area of the sheet holder, the second area being elongated in the sheet-convey direction.

16. The sheet-convey device according to claim 15,
wherein the first area and the second area are set so as to only partly overlap with each other when seen from a direction perpendicular to sheet-convey direction.

17. The sheet-convey device according to claim 15
wherein a downstream end of the second area is located on an upstream side of a downstream end of the first area in sheet-convey direction.

18. The sheet-convey device according to claim 15
wherein a length of the first area in the sheet-convey direction and a length of the second area in the sheet-convey direction are the same as each other.

19. The sheet-convey device according to claim 1,
wherein the sheet holder is configured such that a center thereof in a widthwise direction thereof substantially coincides with a center of the sheet in the widthwise direction thereof when the sheet is placed at the predetermined setting position.

* * * * *